US006601634B2

(12) United States Patent
Weidenbach

(10) Patent No.: US 6,601,634 B2
(45) Date of Patent: Aug. 5, 2003

(54) ILLUMINATING WINDOW COVER

(76) Inventor: Barbara E. Weidenbach, 5839 Westside Rd., Cave Junction, OR (US) 97523

( * ) Notice: Subject to any disclaimer, the term of this patent is extended or adjusted under 35 U.S.C. 154(b) by 0 days.

(21) Appl. No.: 09/738,123

(22) Filed: Dec. 16, 2000

(65) Prior Publication Data

US 2001/0047851 A1 Dec. 6, 2001

Related U.S. Application Data

(60) Provisional application No. 60/172,431, filed on Dec. 17, 1999.

(51) Int. Cl.[7] ..... E06B 9/30

(52) U.S. Cl. ..... 160/166.1 R; 160/10; 160/236; 160/238; 40/542

(58) Field of Search ..... 160/236, DIG. 7, 160/238, 10; 40/542

(56) References Cited

U.S. PATENT DOCUMENTS

| | | | | |
|---|---|---|---|---|
| 2,347,285 | A | * | 4/1944 | Russell |
| 2,395,073 | A | | 2/1946 | Schepmoes |
| 2,749,794 | A | * | 6/1956 | O'Leary |
| 3,236,290 | A | * | 2/1966 | Lueder |
| 3,664,291 | A | * | 5/1972 | Fritz |
| 4,049,038 | A | * | 9/1977 | Hyman et al. |
| 4,514,725 | A | | 4/1985 | Bristley |
| 4,745,286 | A | * | 5/1988 | Jones |
| 4,799,526 | A | * | 1/1989 | Reeves |
| 5,119,871 | A | * | 6/1992 | Schwaegerle |
| 5,271,447 | A | * | 12/1993 | Aronovich |
| 5,400,848 | A | * | 3/1995 | Gainer |
| 5,407,178 | A | * | 4/1995 | Long |
| 5,636,676 | A | | 6/1997 | Fishlin |
| 5,655,589 | A | | 8/1997 | Vartanian |
| 5,677,417 | A | * | 10/1997 | Muellen et al. |
| 5,811,174 | A | * | 9/1998 | Murakami |

FOREIGN PATENT DOCUMENTS

| | | | |
|---|---|---|---|
| CA | 1264284 | * | 1/1990 |
| DE | 2313981 | * | 9/1974 |

* cited by examiner

*Primary Examiner*—Blair M. Johnson
(74) *Attorney, Agent, or Firm*—Steven J. Adamson

(57) ABSTRACT

A window cover apparatus that includes a window cover substrate and a mechanism for adjusting the configuration of the substrate relative to a window. Illuminating material such as phosphorescent or luminescent material is provided on or in the substrate to provide illumination in darkness. The illuminating material may contain color pigment and be configured to provide a colorful design in both daylight and darkness.

21 Claims, 1 Drawing Sheet

ILLUMINATING WINDOW COVER

CROSS REFERENCE TO RELATED APPLICATIONS

This application claims the benefit of U.S. Provisional Application No. 60/172,431, filed Dec. 17, 1999, and having the same title and inventor(s) as above.

FIELD OF THE INVENTION

The present invention relates to window coverings and, more specifically, to window coverings that provide luminescence-type illumination.

BACKGROUND OF THE INVENTION

Children often sleep in a room that has a night light. The light provides a sense of security and aids a child in finding a bathroom or parent. The light may also aid a parent in conversely finding and assisting a child. Other persons, including elderly and sick, may similarly use and benefit from a night light.

Current night lights typically consist of an integrally formed plug and socket. A cover or other bulb protecting piece is often placed over the bulb. This piece may include an image of a popular cartoon character or other character or creature recognized by the child.

While beneficial in providing light, electrical night lights are disadvantageous in that they draw electrical current (however minimal), require replacement of burned out bulbs, may cause electrical shock or burn hazards, and when viewed from an unshielded angle produce distressing glare. A need thus exists for a light that is comforting, practical, and child friendly, and that does not suffer from the above-mentioned disadvantages of electric night lights.

With respect to windows and window coverings, windows are a typical source of daytime light and children grow accustomed to light from this source. Little prior art exists, however, that uses window structures or window covers as a nighttime light source.

SUMMARY OF THE INVENTION

Accordingly, it is an object of the present invention to provide a window covering that also functions as a nighttime light source.

It is another object of the present invention to provide such a window covering that utilizes a non-electric light source.

It is another object of the present invention to provide such a window covering that utilizes phosphorescent/luminescent (glow-in-dark) material as a light source.

It is also an object of the present invention to provide such a window covering in which the P/L material is charged by sunlight through the window covering.

These and related objects of the present invention are achieved by use of an illuminating window cover as described herein.

In one embodiment, the present invention includes a window covering that has a window covering substrate and phosphorescent/luminescent (P/L) material coupled to that substrate. The P/L material may provide-glow-in-the-dark illumination and may be formed on and/or in the substrate.

The P/L material may include color pigment, and pigment may be included that produces the same or different colors in lightness and darkness, depending on the type of pigment. The P/L material may also be substantially non-visible in daylight.

In another embodiment, the present invention includes an adjustable illuminating window covering that has a window covering substrate, a mechanism that facilitate adjustment of the configuration (i.e., positioning relative to the window) of that substrate and illuminating material coupled to the substrate. The illuminating material may be glow-in-the-dark type material or any suitable non-incandescent or non-household electrical system powered material. The illuminating (P/L) material may be provided in any portion of the window covering, including the substrate, positioning mechanisms, cords, valances, decorative tape, etc. The entire substrate may be treated with P/L material or merely a small region of pattern, or anything in between. The window covering substrate may be made of any suitable material (or combination thereof), including metal, wood, cloth, plastic, other synthetics, etc.

Related features and material are also included within the present invention.

The attainment of the foregoing and related advantages and features of the invention should be more readily apparent to those skilled in the art, after review of the following more detailed description of the invention taken together with the drawings.

DETAILED DESCRIPTION

Figure 1:
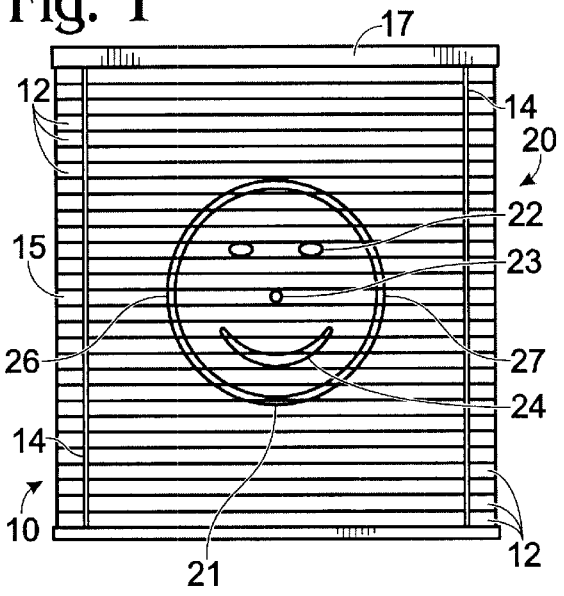
FIG. 1 is an interior view of a window cover in accordance with the present invention.

Referring to FIG. 1, an interior view of a window cover 10 in accordance with the present invention is shown. Window covering 10 is preferably implemented as a venetian blind (common variants are often referred to as "mini-blinds"), though other adjustable blind arrangements are contemplated and within the present invention.

Typically, venetian blinds include a plurality of similarly disposed slats 12 that are coupled and controlled by support wires or cords 14 (portions of which are shown in FIG. 1). These slats may be made of wood, plastic or another suitable material. In a preferred embodiment, discussed in more detail with reference to FIGS. 3–4, these slats are formed of a material that permits passage of exterior light to charge the phosphorescent/luminescent (P/L) material of the pattern provided on the blind. The slat material may be a plastic of suitable porosity for some degree of light passage or maybe light blocking.

The slats of a venetian blind are capable of movement between a vertical and a horizontal position. In FIG. 1, the slats are shown in the vertical position. It is known in the art that Venetian blinds typically include a substantially rigid base member 17 that is attached by mounting hardware to a window frame. The slats 12 are coupled to base member 17 via chords 14. The base member typically includes a mechanism coupled to chords 14 that permits retraction of slats 12 toward the base member to effectively raise the blind and that permits extension of slats 12 downward from the base member to lower the blind. Base member 17 also typically includes a mechanism for moving slats 12 between the horizontal and vertical positions.

A pattern 20 of P/L material is preferably provided on or within the blind material that forms window cover 10. Various types of P/L or "glow in the dark" material is known in the art and available commercially. Any of this material is suitable for the present invention, assuming that it can be fixedly applied to a window cover substrate. Suitable P/L material is available from Thermal Lettering of Loveland, CO, located on the Internet at www.glowinthedark.com.

Pattern 20 is preferably formed on or in blind 10 when the slats are in their vertical position. In this manner, pattern 20 is aligned from one slat to the next. Pattern 20 may be formed by painting on the blind with a P/L material or from stickers or another type of laminate or the like. Pattern 20 may also be formed by diffusion of suitable P/L material, at least in part, into the material of the window cover substrate (FIG. 4), or in any other suitable manner.

Pattern 20 of FIG. 1 illustrates a "happy face" which includes a large "face" circle 21, eyes 22, nose 23 and mouth 24. Slat 15 includes nose 23 and portions 26–27 of the face circle. Formation of these features is discussed in more detail below with reference to FIGS. 3–4.

Figure 2:
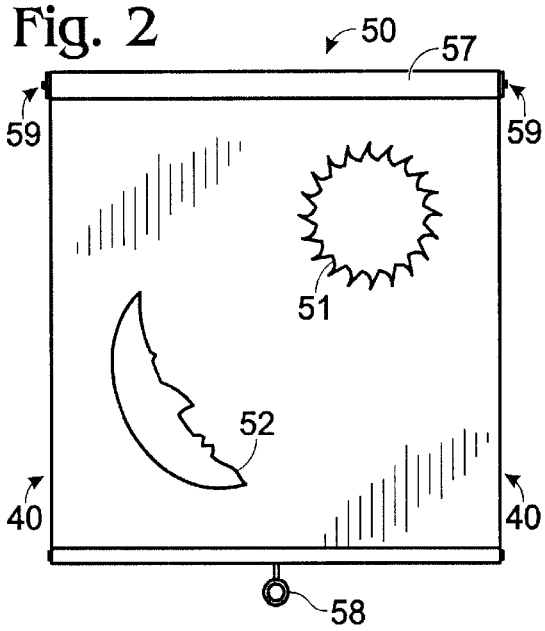
FIG. 2 is a view of a pull down blind having a luminescence pattern in accordance with the present invention.

Referring to FIG. 2, a view of a pull down blind 40 having a pattern 50 in accordance with the present invention is shown. (Note that pull down blinds may also be referred to as roll-up shades or by other names.) Pull down blinds without P/L patterns are known in the art and are available commercially. They typically include a substantially rigid base member 57 that includes a roller and a spring loaded mechanism that permits extension of blind material from the base member and retraction of shade material towards the base member. Retraction is often instigated by a slight downward tug on the shade, for example, via ring 58. FIG. 2 illustrates two mounting pins for mounting the blind onto window mounting hardware.

The illustration of a Venetian or mini blind in FIG. 1 and a pull-down blind in FIG. 2 is intended to illustrate two examples of the broad range of window covering substrates that P/L material may be applied to in accordance with the present invention. The luminescent patterning of the present invention may be applied to any type of window cover including, but not limited to, those shown herein and Levelor®, cellular, and vertical slat, etc. Levelor® makes several blinds or shades with a substantially rigid base member and blind material positioning mechanism. Cellular or pleated blinds typically have a substantially rigid base member from which blind material extends and retracts. Vertical slat blinds typically have a substantially rigid base member from which a plurality of moveable vertical slats descend.

Pattern 50 includes a sun design 51 and a moon design 52. These designs and the design of pattern 20 of FIG. 1 are representative. While any design may be provided, the designs of patterns 20 and 50 are intended to be child friendly, thus providing security and/or entertainment for a child. The designs may, however, be more artistically or otherwise set forth to attract adult users. Furthermore, the arrangement and concentration, etc., of P/L material may be varied to provide different lighting effects.

Figure 3:
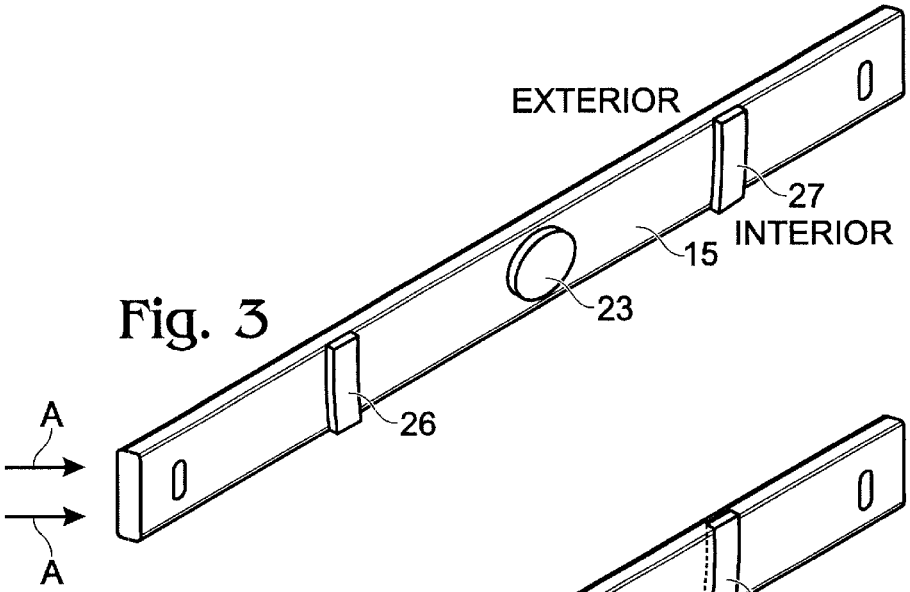
FIG. 3 is a perspective view of a slat of the blind of FIG. 1 formed in a first manner in accordance with the present invention.

Referring to FIG. 3, a perspective view of a slat 15 of FIG. 1 with P/L material laminated thereon in accordance with the present invention is shown. Slat 15 may be made of a material that is light blocking or light passing.

With respect to the light passing embodiment, arrows A indicates the passage of sunlight through slat 15 onto the P/L material to charge the P/L material from behind. Nose 23 and sections 26,27 of the face circle of FIG. 1 are shown in FIG. 3. Passage of sunlight onto the P/L material causes a charging of this material. Thus, when nighttime arrives the P/L material produces illumination, without being charged (or in addition to being charged by an interior light, i.e., the P/L material is naturally charged by sunlight passing through the window cover. It should be recognized, however, that slats or other blind material may be formed of light blocking material or the like. In this case, the P/L material may be charged by interior light or the exterior light from another window, etc. If the light blocking window cover is a Venetian or vertical blind or the like, the P/L material may be charged when the slats are rotated perpendicular to the plane of the window to let light pass.

Figure 4:
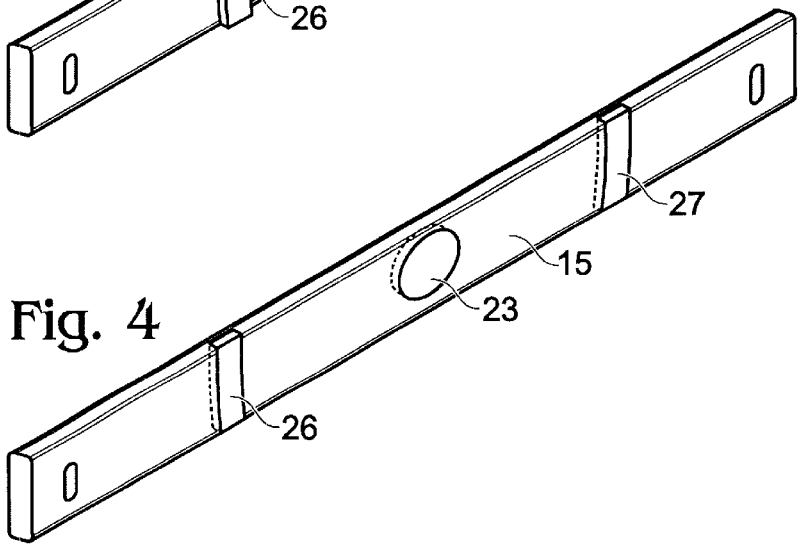
FIG. 4 is a perspective view of a slat of the blind of FIG. 1 formed in another manner in accordance with the present invention.

Referring to FIG. 4, a perspective view of a slat 15 of FIG. 1 with P/L material diffused therein in accordance with the present invention is shown. Slat 15 in FIG. 4 includes sections 26,27 and nose 23 shown as being diffused into the slat material. The type of diffusion will depend to some extent on the porosity on type of material used for the substrate, e.g., wood, plastic, etc. Various methods of diffusion or impregnation or the like for different materials are known in the art.

It should be recognized that the P/L material that forms designs 20,50 may be all of one color (for example, a typical glow-in-the-dark yellow-green) or may contain pigments that provide colors. In one preferred embodiment, the P/L material contains pigments or the like such that the designs are visible in color in daylight and also "glow" in color in darkness. In a further preferred embodiment, the daylight and darkness colors are approximately the same color.

It should also be recognized that while the embodiments of FIGS. 1–2 illustrate patterned P/L material, the P/L material may be applied to all and any region or part of the window covering.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. An illuminating window covering, comprising:

a window covering substrate having an interior and an exterior surface;

a substantially rigid base member to which said substrate is coupled, said base member adapted for mounting to a window frame;

a mechanism that facilitates extension of said substrate from said base member and retraction of said substrate towards said base member;

phosphorescent/luminescent (P/L) material applied to a portion of the interior surface of said substrate; and said substrate is configured at least in part to permit light impinging on said exterior surface of said substrate to pass through said substrate to charge the P/L material on the interior surface of said substrate such that the P/L material emits light visible to a human eye looking at the interior surface of the substrate.

2. The window covering of claim 1, wherein said P/L material provides glow-in-the-dark illumination.

3. The window covering of claim 1, wherein said material is at least in part formed on said substrate.

4. The window covering of claim 1, wherein said material is at least in part diffused into said substrate.

5. The window covering of claim 1, wherein said substrate is a pull-down-type blind.

6. The window covering of claim 1, further comprising color pigment in the P/L material.

7. The window covering of claim 1, wherein said P/L material produces light of two different color.

8. The window covering of claim 1, wherein said portion is less than all of the interior surface.

9. The window covering of claim 1, wherein said window covering substrate is of the slatted blind type.

10. The window covering of claim 1, wherein said P/L material is substantially non-visible in daylight and visible in darkness.

11. An illuminating window covering, comprising:

a window covering substrate having an interior and an exterior surface;

a substantially rigid base member to which said substrate is coupled, said base member adapted for mounting to a window frame;

a mechanism that facilitates adjustment of the position of the substrate relative to said base member;

phosphorescent/luminescent (P/L) material coupled to a portion, less than all, of the interior surface of said substrate; and said substrate is configured at least in part to permit light impinging on said exterior surface of said substrate to pass through said substrate to charge the P/L material on the interior surface of said substrate such that the P/L material emits light visible to a human eye looking at the interior surface of the substrate.

12. An adjustable illuminating window covering, comprising:

a window covering substrate having an interior and an exterior surface;

a substantially rigid base member to which said substrate is coupled, said base member adapted for mounting to a window frame;

a mechanism that facilitates adjustment of the position of said substrate relative to said base member;

illuminating material applied to said substrate that functions as a light source after exposure to incident light; and said substrate is configured at least in part to permit light impinging on said exterior surface of said substrate to pass through said substrate to charge the illuminating material on the interior surface of said substrate such that the P/L material emits light visible to a human eye looking at the interior surface of the substrate.

13. The window covering of claim 12, wherein said illuminating material is glow-in-the-dark material.

14. The window covering of claim 12, wherein said illuminating material is non-incandescent material.

15. The window covering of claim 12, wherein said window covering is of the slatted blind type.

16. The window covering of claim 12, wherein said illuminating material includes phosphorescent color pigment.

17. The window covering of claim 12, wherein said illuminating material produces light of two different colors as perceived by the human eye.

18. The window covering of claim 12, wherein said window covering is of the type that includes a pull down function.

19. The window covering of claim 12, wherein said illuminating material is phosphorescent/luminescent material.

20. The window covering of claim 12, wherein said illuminating material is applied to the interior surface of said substrate.

21. The window covering of claim 12, wherein said illuminating material is applied to a portion, less than all, of the interior surface of said substrate.

* * * * *